United States Patent [19]

Osher et al.

[11] Patent Number: 4,944,363

[45] Date of Patent: Jul. 31, 1990

[54] TOY BALL

[75] Inventors: John D. Osher, Shaker Heights, Ohio; Allison W. Katzman; Mark Luecke, both of Chicago, Ill.; John R. Wildman, North Riverside, Ill.

[73] Assignee: Cap Toys, Inc., Bedford Heights, Ohio

[21] Appl. No.: 475,716

[22] Filed: Feb. 6, 1990

[51] Int. Cl.[5] ..... A63B 37/06; A63B 45/00; A63B 37/08

[52] U.S. Cl. ..... 273/58 A; 273/58 H; 273/DIG. 5; 273/58 J; 273/DIG. 20; 446/267; 446/491; 446/385; 446/369

[58] Field of Search ..... 273/58 R, 58 A, 58 C, 273/58 H, 58 J, 58 K, 60 R, 60 B, 61 C, 128 A, DIG. 20, DIG. 29, 26 R, 29 A; 446/267, 491, 369, 380, 382, 385, 390, 391

[56] References Cited

U.S. PATENT DOCUMENTS

| | | | |
|---|---|---|---|
| 242,827 | 7/1947 | Chagnon | 273/61 |
| 2,484,397 | 10/1949 | Barton | 273/199 R |
| 2,743,931 | 5/1956 | Pooley et al. | 273/60 B |
| 2,753,599 | 7/1956 | Pietraszek et al. | 273/60 B |
| 2,830,402 | 4/1958 | Schleich | 446/385 |
| 2,935,320 | 5/1960 | Chupa | 273/58 J |
| 3,238,599 | 3/1966 | Bauman | 446/385 |
| 3,490,770 | 1/1970 | Satchell et al. | 273/231 |
| 3,601,923 | 8/1971 | Rosenberg | 446/267 |
| 3,605,330 | 9/1971 | Sivelle et al. | 446/382 |
| 3,616,101 | 10/1971 | Satchell et al. | 273/231 X |
| 3,676,387 | 7/1972 | Lindlof | 260/28.5 B |
| 3,827,999 | 8/1974 | Crossland | 260/33.6 AQ |
| 3,927,882 | 12/1975 | Galarza | 273/65 E |
| 4,042,057 | 8/1977 | Beckley | 280/751 |
| 4,367,873 | 1/1983 | Chang et al. | 273/60 R |
| 4,369,284 | 1/1983 | Chen | 524/476 |
| 4,463,951 | 8/1984 | Kumasaka et al. | 273/58 A |
| 4,498,667 | 2/1985 | Tomar | 273/60 B |
| 4,618,213 | 10/1986 | Chen | 350/96.34 |
| 4,657,021 | 4/1987 | Perry et al. | 446/267 |
| 4,772,019 | 9/1988 | Morgan | 273/60 B |

FOREIGN PATENT DOCUMENTS

| | | | |
|---|---|---|---|
| 1268431 | 3/1972 | United Kingdom | 273/58 A |

*Primary Examiner*—George J. Marlo
*Attorney, Agent, or Firm*—Wood, Herron & Evans

[57] ABSTRACT

A resiliently deformable toy ball which is soft and supple and provides an intriguing relaxing feeling when squeezed, and which possesses a low rebound percentage due to its resliently deformable nature. The ball has a highly plasticized PVC core which is resiliently deformable due to its highly plasticized state. The PVC core is encased in a flexible polymer shell and both the core and the flexible shell are further encased in a stretchable fabric outer cover.

10 Claims, 1 Drawing Sheet

TOY BALL

FIELD OF THE INVENTION

The present invention relates to toy balls, and more particularly to resiliently deformable toy balls which are soft and supple and thereby provide an intriguing relaxing feeling when squeezed, and which also possess a low rebound percentage due to their resiliently deformable nature.

BACKGROUND

Numerous types of toy balls are known which are made of various synthetic materials. For example, U.S. Pat. No. 4,772,019 discloses a composite safety ball having a polyurethane foam core which is designed to replicate the performance of a regulation baseball or softball. U.S. Pat. No. 3,927,882 discloses a soccer ball which has a polyethylene core and an inner nylon cover. U.S. Pat. Nos. 3,616,101 and 3,490,770 disclose liquid center balls, such as golf balls, in which the central portion is a liquid polymer such as polyvinyl chloride. Due to the nature of the materials from which these types of balls are made, and the manner in which they are made, these types of balls are not resiliently deformable to the extent that they would provide a soft, supple feel when squeezed.

Other materials are known which possess resilient or elastomeric properties. For example, U.S. Pat. Nos. 4,369,284 and 4,618,213 are directed to particular elastomeric gelatinous compounds which may be molded into toy balls. While balls made of these types of materials are resilient, they possess an extremely high percentage of plasticizing oil, which tends to bleed or leach out of the ball body. This is undesirable because the user of the ball tends to get plasticizer all over himself and the ball may become brittle and subject to tearing or cracking as it loses plasticizer.

SUMMARY OF THE INVENTION

The present invention is directed to a toy ball which has a rebound characteristic on the order of about 9%, which is directly proportional to the height from which the ball is dropped. Preferably, the ball has a highly plasticized polyvinyl chloride core which is resiliently deformable due to its highly plasticized state. The highly plasticized core is encased in a flexible polymer shell and both the core and the flexible shell are further encased in a stretchable fabric outer cover. Due to the highly plasticized nature of the polyvinyl chloride core, the toy ball of the present invention provides a soft and supple resilient feeling to a person holding and squeezing the ball. The feel of the ball is both intriguing and relaxing Furthermore, the flexible polymer shell encasing the core substantially prevents bleeding of the plasticizer from the core through the fabric outer cover, thus protecting the user from exposure to the plasticizer and ensuring the ball retains its soft and supple resiliency. The fabric outer cover, which is preferably a synthetic fiber material enhances the "feel" of the ball, protects the core and shell and prevents tearing thereof and also provides the aesthetic appeal of the toy ball of the present invention.

DETAILED DESCRIPTION OF THE INVENTION

Figure 1:
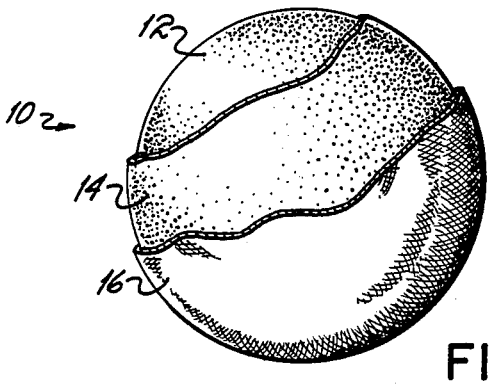
FIG. 1 is a perspective view, partially broken away, of the toy ball of the present invention.

With reference to FIG. 1, a preferred embodiment of the toy ball 10 of the present invention comprises a highly plasticized polyvinyl chloride (PVC) core 12, a flexible polymer shell 14 encasing core 12, and a stretchable fabric outer cover 16 encasing core 12 and shell 14. The shell is about 0.012 inches thick.

In a preferred embodiment, core 12 is formed from the following components in the percentages indicated:

| | |
|---|---|
| Polyvinyl chloride powder | 25% |
| Di-n-butyl phthalate | 50% |
| Epoxy plasticizer | 10% |
| Stabilizer | 14% |
| Fragrances | 1% |

Di-n-butyl phthalate (DINP) is a plasticizer and thus the total percentage of plasticizer (DINP and epoxy plasticizer) in the core is 60%, in a preferred embodiment. That is, the ra of plasticizer to PVC is about 2.4:1. The PVC core exhibits a very soft and supple resilient feeling when it is deformed (squeezed) due to its highly plasticized state. This also accounts for the low rebound percentage (about 9%) which characterizes the toy ball of the present invention.

The polyvinyl chloride powder used in making the core can be one of any known type, since its specific formulation is not critical to the present invention. Likewise, the stabilizer, the epoxy plasticizer, and the fragrances can each be one of any known such compounds, or combinations thereof, since their specific formulations are also not critical to the present invention. The only criticality in the core composition is that the PVC be highly plasticized to the extent that the toy ball has a low rebound characteristic when dropped and is resiliently deformable. The test procedures and results for rebound and deformability will be described in greater detail below.

Also in a preferred embodiment, flexible shell 14 is comprised of the following:

| | |
|---|---|
| Latex | 80% |
| Kaolin | 14% |
| Zinc oxide | 4% |
| Sulfur | 2% |

The critical aspect of the composition of the flexible shell is that it must be thin (about 0.012") while being substantially impervious to the plasticizer used in the core. To this end, synthetic latex rubber is preferred over natural rubber since many plasticizers cause the breakdown of natural rubber.

Fabric outer cover 16 is to protect flexible shell 14 and core 12 from tears and the like, and therefore must be a substantially tear resistant material. In a preferred embodiment, the fabric outer cover is comprised of about 80% nylon and about 20% spandex—a two-way stretch fabric to give the stretch necessary for the ball to retain its resiliently deformable characteristic.

The toy ball of the present invention is formed using the following generally known procedures. First, the core 12 is cast by mixing the above-listed compounds together and heating them until a molten mixture is formed. Subsequently, the molten mixture is poured into a mold having the desired size and shape and allowed to cure for 15–20 minutes. The core is then further cured and cooled by dipping the mold in cold water and the molded core is removed from the mold.

The flexible shell 14 is formed using a procedure known as slush casting. In this procedure, the compounds listed above for the shell are mixed together by stirring and heated until a molten mixture is formed. Subsequently, the molten mixture is poured into a relatively cold mold so that a layer of the molten compound cures or sets up and forms a "skin" or shell on the mold wall. The thickness of the shell can be varied by varying the temperature of the mold and the length of time the molten material is in the mold. Additionally, the size and shape of the mold are such that the shell formed therein can encase the core formed previously. After a suitable period of time the remaining molten material is poured out of the mold, thus leaving the shell formed and remaining in the mold. The shell is taken out of the mold by blowing the mold with hot air. Then the shell can be placed in an oven and further cured to form the completed shell.

Shell 14 is preferably formed such it has a diameter approximately equal to or slightly greater than that of core 12. Preferably, shell 14 is made with a hole approximately 1" in diameter in the surface thereof or such a hole is cut therein. The flexible shell is then stretched and the core is inserted through the hole. The hole in the shell is then patched with a piece of shell material sufficient to cover the hole glued in place.

Finally, the fabric outer cover 16 which encases core 12 and shell 14 is sewn together therearound. Cover 16 is preferably made from multiple pieces of material of different colors and/or patterns to provide a visually attractive and pleasing look.

As mentioned above, due to the nature of the highly plasticized PVC core, the toy ball of the present invention is readily resiliently deformable and possesses a low rebound percentage. That is, when squeezed, the ball of the present invention is readily deformed and feels soft and supple. Upon release of the squeezing force, however, the ball virtually immediately returns to its original shape; the ball does not have retarded resiliency as do the articles disclosed in U.S. Pat. No. 2,830,402.

Figure 2:
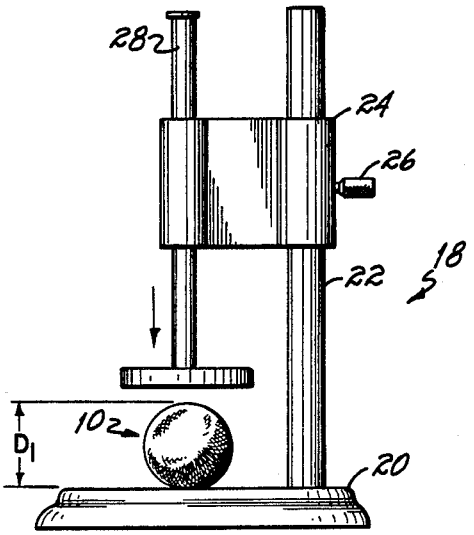
FIG. 2 is a side elevation of a deformability test apparatus with a toy ball positioned for testing.
Figure 3:
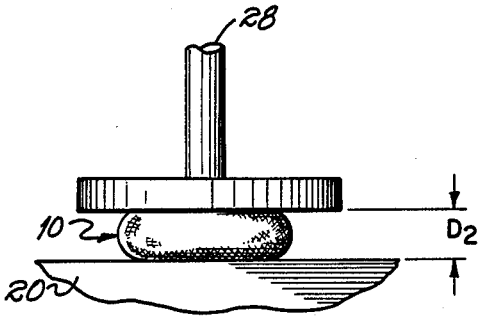
FIG. 3 is an enlarged side elevation of a section of the apparatus shown in FIG. 2, with the toy ball deformed.

FIG. 2 shows a test apparatus 18 for testing the resilient deformability of toy ball 10. Test apparatus 18 includes a rigid base 20 upon which toy ball 10 is placed for testing purposes. Additionally, test apparatus 18 includes an upstanding shaft 22 having a vertically slidably adjustable bracket 24 positioned thereon. Bracket 24 can be secured at a desired vertical level by tightening thumb screw 26. Bracket 24 has an aperture therethrough slidably receiving weighted plunger 28, which is used to deform toy ball 10. As can be seen in FIG. 2, plunger 28 is positioned vertically above toy ball 10 prior to testing the deformability of the ball. Ball 10 has a first diameter designated as $D_1$ in FIG. 2 when the ball is not deformed by any external forces or pressure. When the weight of plunger 28 is allowed to deform ball 10, as shown in FIG. 3, ball 10 takes on a new diameter $D_2$, as measured in the vertical direction in FIG. 3.

In a preferred embodiment of the toy ball of the present invention, $D_1$ is between about 60–67 mm and the ball weighs approximately 150 grams. $D_2$, which is a function of the weight of the plunger, and the length of time the weight is exerted on the ball, is preferably about 33 mm when plunger 28 weighs about 1850 g and has exerted its weight on ball 10 for approximately 2 seconds or less. Thus $D_2$ equals $\frac{1}{2}D_1$ when the weight ratio of the plunger to the ball is about 12.5:1. This test apparatus thereby measures the initial deformation of toy ball 10 by a known force in a defined time period, and disregards the subsequent or further deformation or relaxation of toy ball 10 which may occur if plunger 28 is left to rest on toy ball 10 for longer periods of time.

A preferred embodiment of the toy ball of the present invention was tested for its rebound percentage or characteristic when dropped from a known height onto a rigid surface. Ball 10 was repeatedly dropped from a height of 36" and rebounded between about 3"–3½", for an average of about 9%. Ball 10 was then repeatedly dropped from heights of 48" and 60" to determine if the correlation between the rebound percentage and the height of the drop is linear. From 48", ball 10 rebounded between about 4–4½", for an average of about 9%, and from 60", ball 10 rebounded about 5–5½", also for an average of about 9%. It was therefore determined that the correlation between the height of the drop and the rebound percentage is linear. Both the rebound and deformability tests were conducted at room temperature.

It will be appreciated that the present invention need not and is not limited to toy balls and in fact encompasses all types of articles having a highly plasticized PVC core which is resiliently deformable, a flexible shell encasing the core, and a stretchable fabric outer cover encasing the core and flexible shell.

What is claimed is:

1. A toy ball having a soft and supple feeling and a rebound percentage of about 9%, which is directly proportional to the height from which the ball is dropped, comprising:

a highly plasticized polyvinyl chloride core which resiliently deformable due to its highly plasticized state and bleeds plasticizer;

a flexible polymer shell encasing said core for containing bleeding of the plasticizer from said core; and a stretchable fabric outer cover encasing said core and said flexible shell.

2. The toy ball of claim 1 wherein said core contains about 25% polyvinyl chloride and at least about 60% plasticizer.

3. The toy ball of claim 2 wherein said flexible polymer shell substantially prevents bleeding of said plasticizer from said core through said fabric outer cover.

4. The toy ball of claim 3 wherein said polymer shell includes about 80% latex, 14% kaolin and 4% zinc oxide, said shell being substantially impervious to said plasticizer.

5. The toy ball of claim 2 wherein said core further contains about 14% stabilizer and about 1% of a fragrance compound.

6. The toy ball of claim 1 wherein said stretchable fabric outer cover is about 80% nylon and about 20% spandex.

7. The toy ball of claim 1 wherein said ball has a weight $W_1$, and has a first diameter $D_1$ when no external forces are exerted on said ball and a second diameter $D_2$ when the force of a test weight $W_2$ is exerted on said ball for about 2 seconds, and $D_2$ is about $\frac{1}{2}D_1$, when $W_2$ is about $12.5W_1$.

8. The toy ball of claim 7 wherein $W_1$ is about 150 grams, $W_2$ is about 1850 grams, $D_1$ is between about 60–67 mm, and $D_2$ is about 33 mm.

9. A toy ball having a soft and supple feeling and a rebound percentage which is directly proportional to the height from which the ball is dropped, comprising:

a highly plasticized polyvinyl chloride core which is resiliently deformable due to its highly plasticized state and bleeds plasticizer;

a flexible polymer shell encasing said core for containing bleeding of the plasticizer from said core; and a stretchable fabric outer cover encasing said core and said flexible shell.

10. A toy ball having a soft and supple feeling and a rebound percentage which is directly proportional to the height from which the ball is dropped, comprising:

a highly plasticized polyvinyl chloride core which is resiliently deformable due to its highly plasticized state and bleeds plasticizer;

a flexible polymer shell encasing said core for containing bleeding of the plasticizer from said core;

a stretchable fabric outer cover encasing said core and said flexible shell; and said ball has a weight of about 150 grams, and has a first diameter of between about 60–67 mm when no external forces are exerted on said ball and a second diameter of about 33 mm when the force of a test weight of about 1850 grams is exerted on said ball for about 2 seconds.

* * * * *

UNITED STATES PATENT AND TRADEMARK OFFICE

CERTIFICATE OF CORRECTION

PATENT NO. : 4,944,363

DATED : July 31, 1990

INVENTOR(S) : John D. Osher et al.

It is certified that error appears in the above-identified patent and that said Letters Patent is hereby corrected as shown below:

Column 1, line 55, "relaxing" should be --relaxing.--

Column 2, line 28, "ra" should be --ratio--

Column 4, line 42, after "which" insert --is--

Signed and Sealed this

Tenth Day of November, 1992

*Attest:*

DOUGLAS B. COMER

*Attesting Officer*

*Acting Commissioner of Patents and Trademarks*